US011103401B2

(12) United States Patent
Bradford

(10) Patent No.: US 11,103,401 B2
(45) Date of Patent: Aug. 31, 2021

(54) PATIENT LIFTING ASSEMBLY

(71) Applicant: Sonia Bradford, Allentown, PA (US)

(72) Inventor: Sonia Bradford, Allentown, PA (US)

( * ) Notice: Subject to any disclaimer, the term of this patent is extended or adjusted under 35 U.S.C. 154(b) by 188 days.

(21) Appl. No.: 16/374,186

(22) Filed: Apr. 3, 2019

(65) Prior Publication Data

US 2020/0315887 A1 Oct. 8, 2020

(51) Int. Cl.
*A61G 7/10* (2006.01)

(52) U.S. Cl.
CPC ..... *A61G 7/1015* (2013.01); *A61G 7/1019* (2013.01); *A61G 7/1073* (2013.01); *A61G 2200/34* (2013.01)

(58) Field of Classification Search
CPC ..... A61G 7/1015; A61G 7/1073; A61G 2200/34; A61G 7/1019; A61G 7/0506; A61H 1/0222; A61H 1/0218; A61H 1/0229; A47C 19/022
See application file for complete search history.

(56) References Cited

U.S. PATENT DOCUMENTS 4,579,109 A * 4/1986 Lundblad ..... A61H 1/0222 606/242
4,644,595 A 2/1987 Daniel
5,107,554 A 4/1992 Garakani
D327,763 S 7/1992 Silbersky
7,536,738 B2 5/2009 Richards
8,572,774 B1 * 11/2013 Osika ..... A61G 7/10 5/83.1
8,710,950 B2 4/2014 Lubbers
9,131,907 B2 9/2015 Moy
9,333,138 B2 5/2016 Moriarty
2002/0029418 A1 * 3/2002 Votel ..... A61G 7/1026 5/81.1 RP
2004/0221388 A1 * 11/2004 Votel ..... A61G 7/1026 5/81.1 HS
2005/0155149 A1 * 7/2005 Pedersen ..... A61G 7/1032 5/81.1 R
2006/0162083 A1 7/2006 Heimbrock
2006/0260054 A1 * 11/2006 Lubbers ..... A61G 7/05 5/621
2010/0280549 A1 * 11/2010 Yen ..... A61P 25/00 606/237
2018/0168899 A1 * 6/2018 Newkirk ..... A61G 7/018

* cited by examiner

*Primary Examiner* — Robert G Santos
*Assistant Examiner* — Alison N Labarge

(57) ABSTRACT

A patient lifting assembly includes a first housing that is coupled to a vertical support surface to be positioned adjacent to a user's head when the user is lying in a bed. A first cable is retracted or extended outwardly from the first housing. A first handle is coupled to the first cable and the first handle can be gripped by a user to urge the user toward the head of the bed. A second housing is coupled to a vertical support surface to be positioned adjacent to a user's feet when the user is lying in the bed. A second cable is retracted or extended outwardly from the second housing. A second handle is coupled to the second cable and the second handle can be gripped by a user to urge the user into an upright, seated position.

11 Claims, 7 Drawing Sheets

PATIENT LIFTING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to lifting devices and more particularly pertains to a new lifting device for urging a bedridden user into an upright, seated position.

BRIEF SUMMARY OF THE INVENTION

An embodiment of the disclosure meets the needs presented above by generally comprising a first housing that is coupled to a vertical support surface to be positioned adjacent to a user's head when the user is lying in a bed. A first cable is retracted or extended outwardly from the first housing. A first handle is coupled to the first cable and the first handle can be gripped by a user to urge the user toward the head of the bed. A second housing is coupled to a vertical support surface to be positioned adjacent to a user's feet when the user is lying in the bed. A second cable is retracted or extended outwardly from the second housing. A second handle is coupled to the second cable and the second handle can be gripped by a user to urge the user into an upright, seated position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
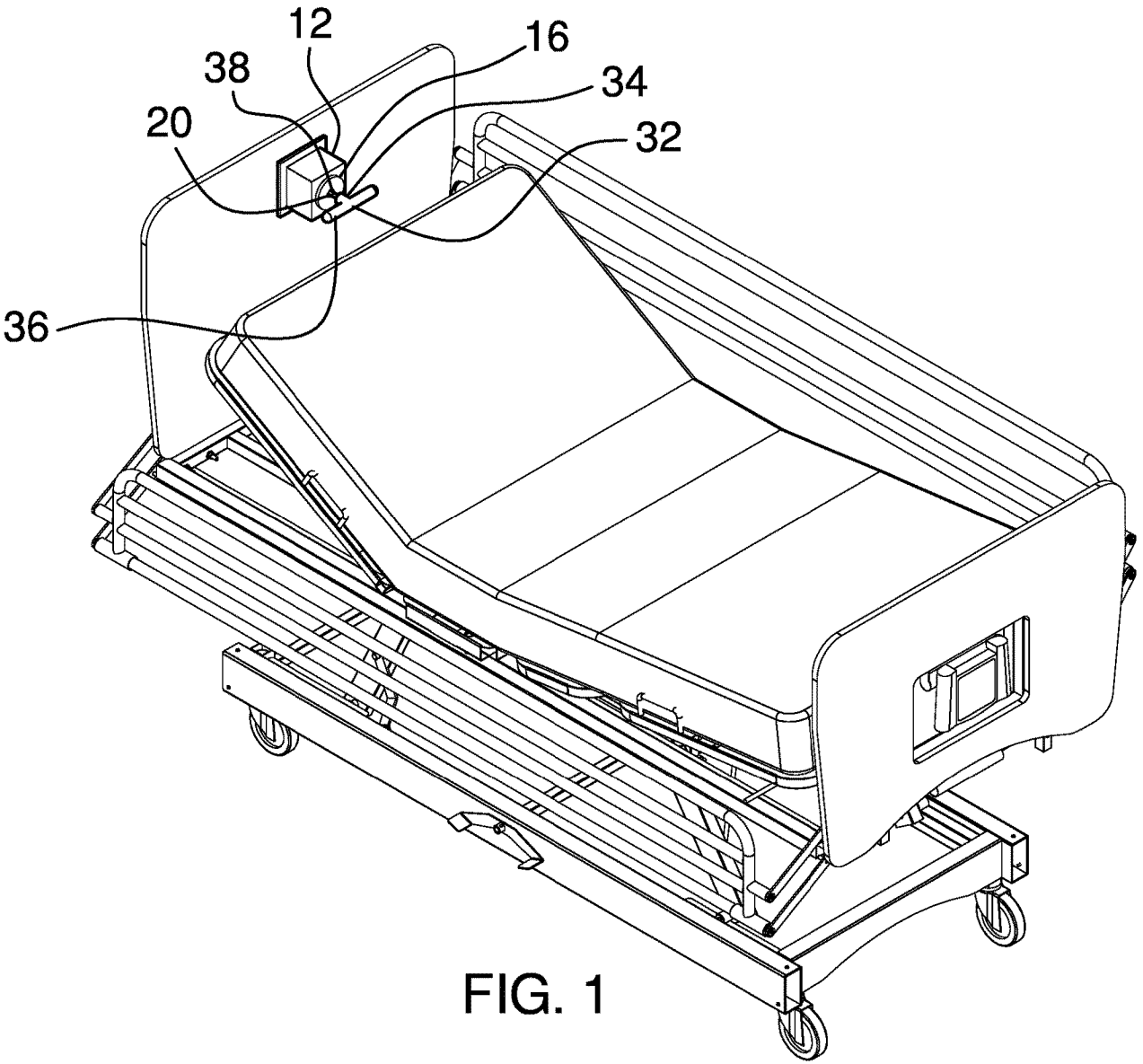
FIG. 1 is a front perspective view of a patient lifting assembly according to an embodiment of the disclosure.
Figure 2:
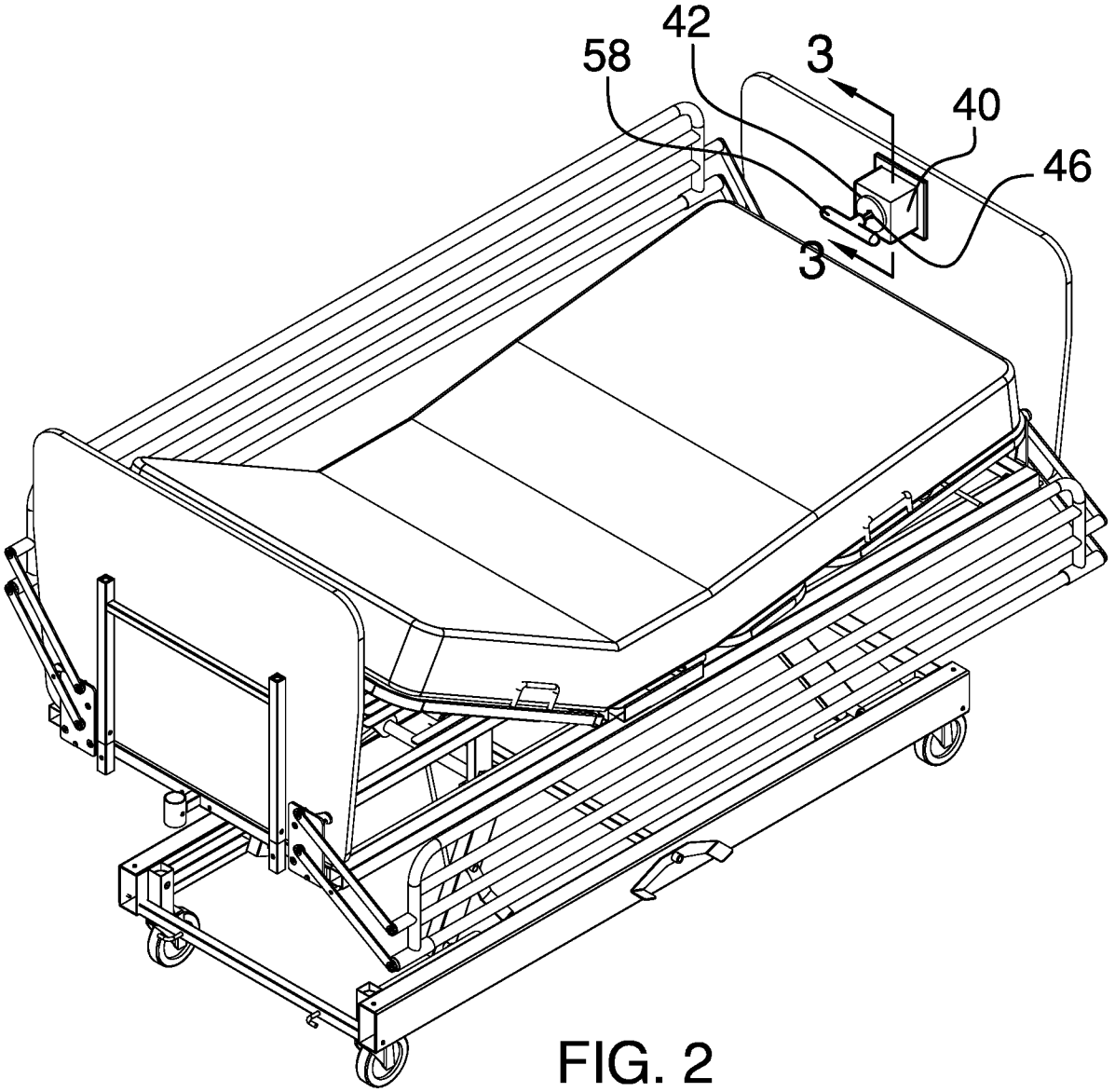
FIG. 2 is a back perspective view of an embodiment of the disclosure.
Figure 3:
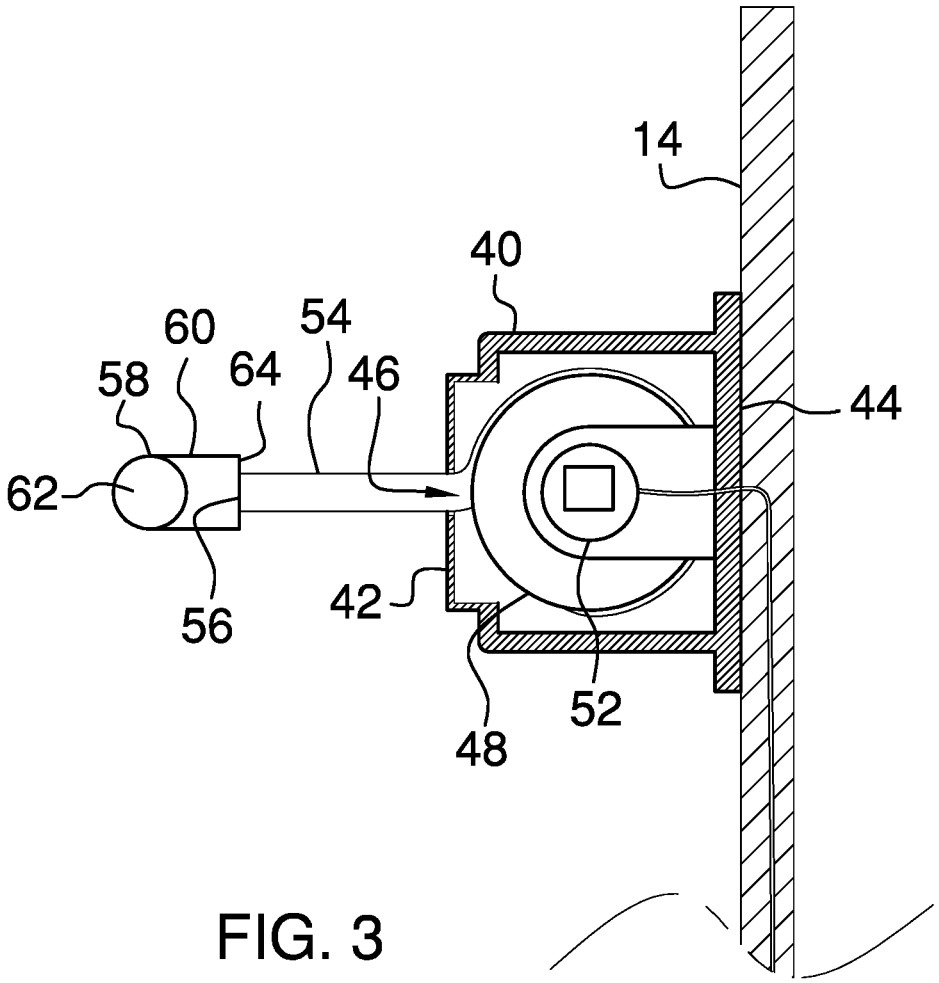
FIG. 3 is a cross sectional view taken along line 3-3 of FIG. 2 of an embodiment of the disclosure.
Figure 4:
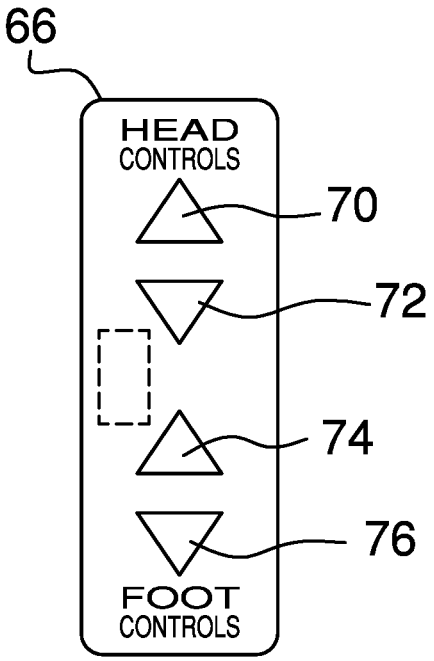
FIG. 4 is a front view of a remote control of an embodiment of the disclosure.
Figure 5:
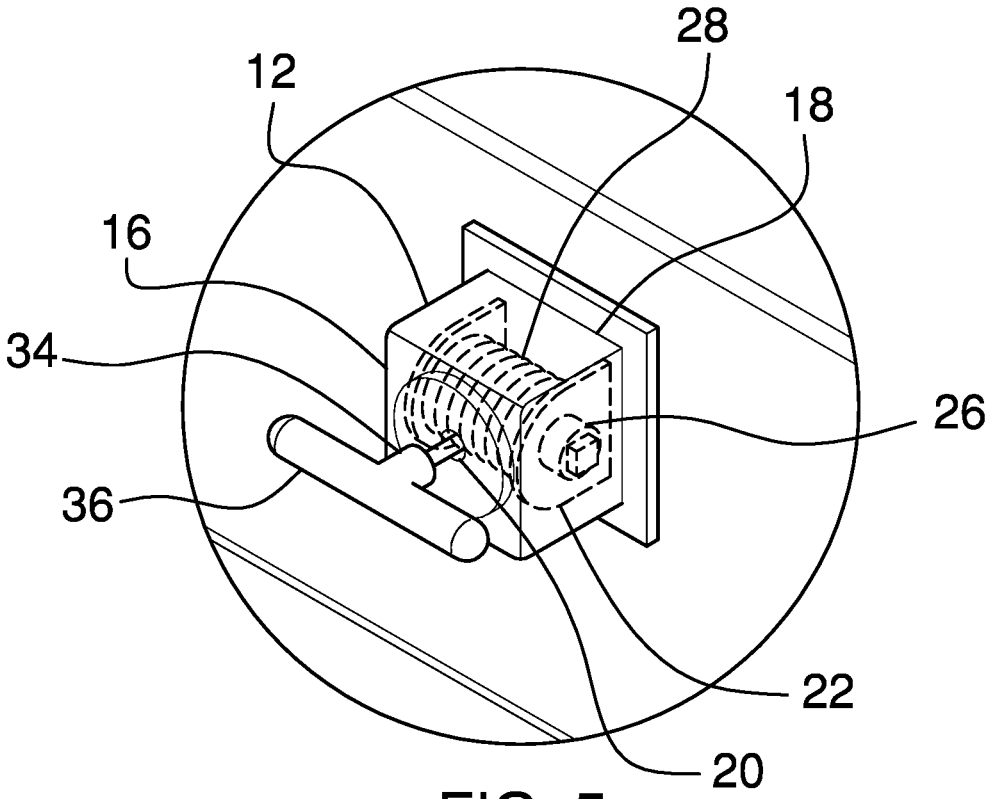
FIG. 5 is a perspective phantom view of a first housing of an embodiment of the disclosure.
Figure 6:
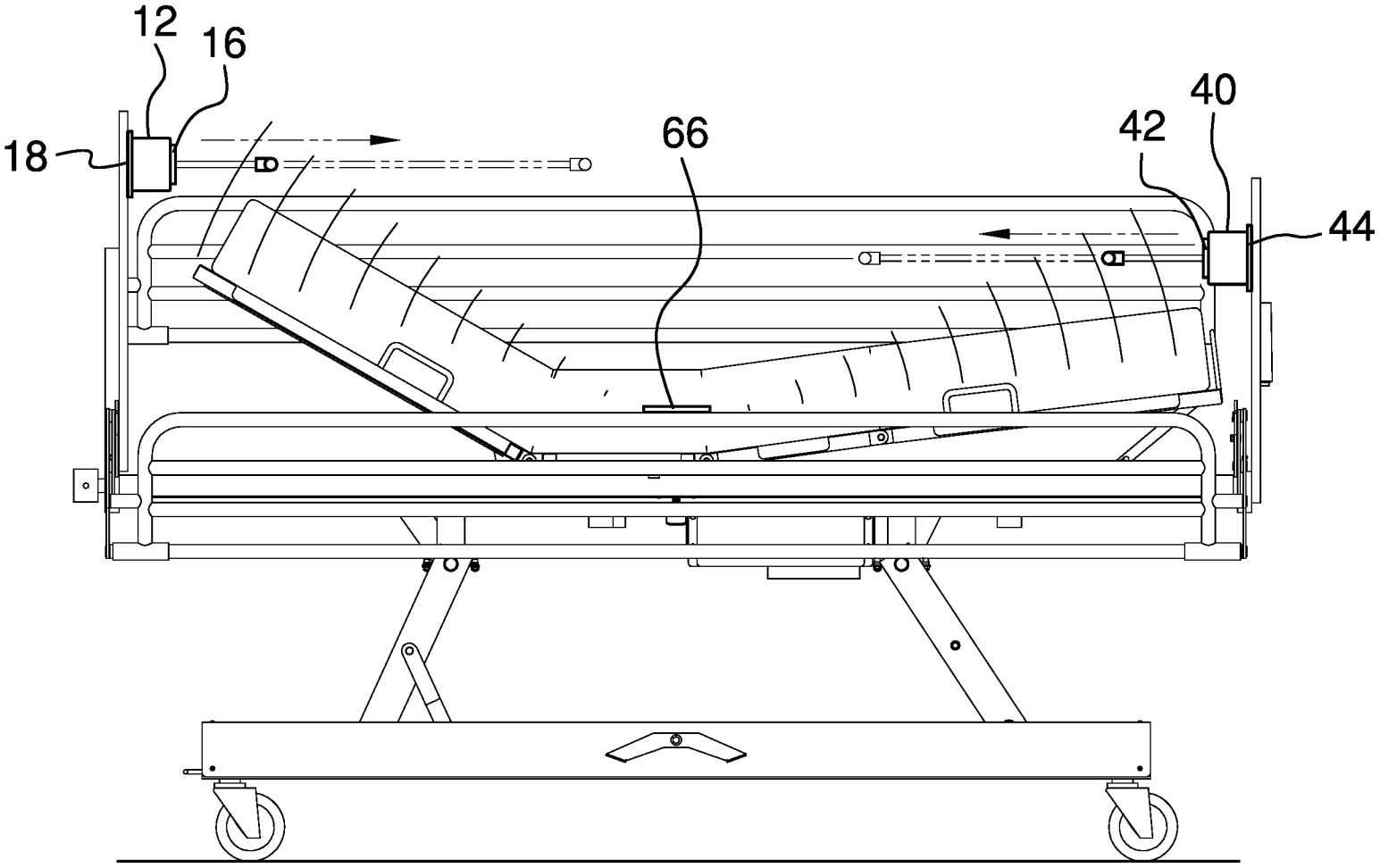
FIG. 6 is a perspective in-use view of an embodiment of the disclosure showing a first housing and a second housing each being coupled to a respective headboard and footboard of a bed.
Figure 7:
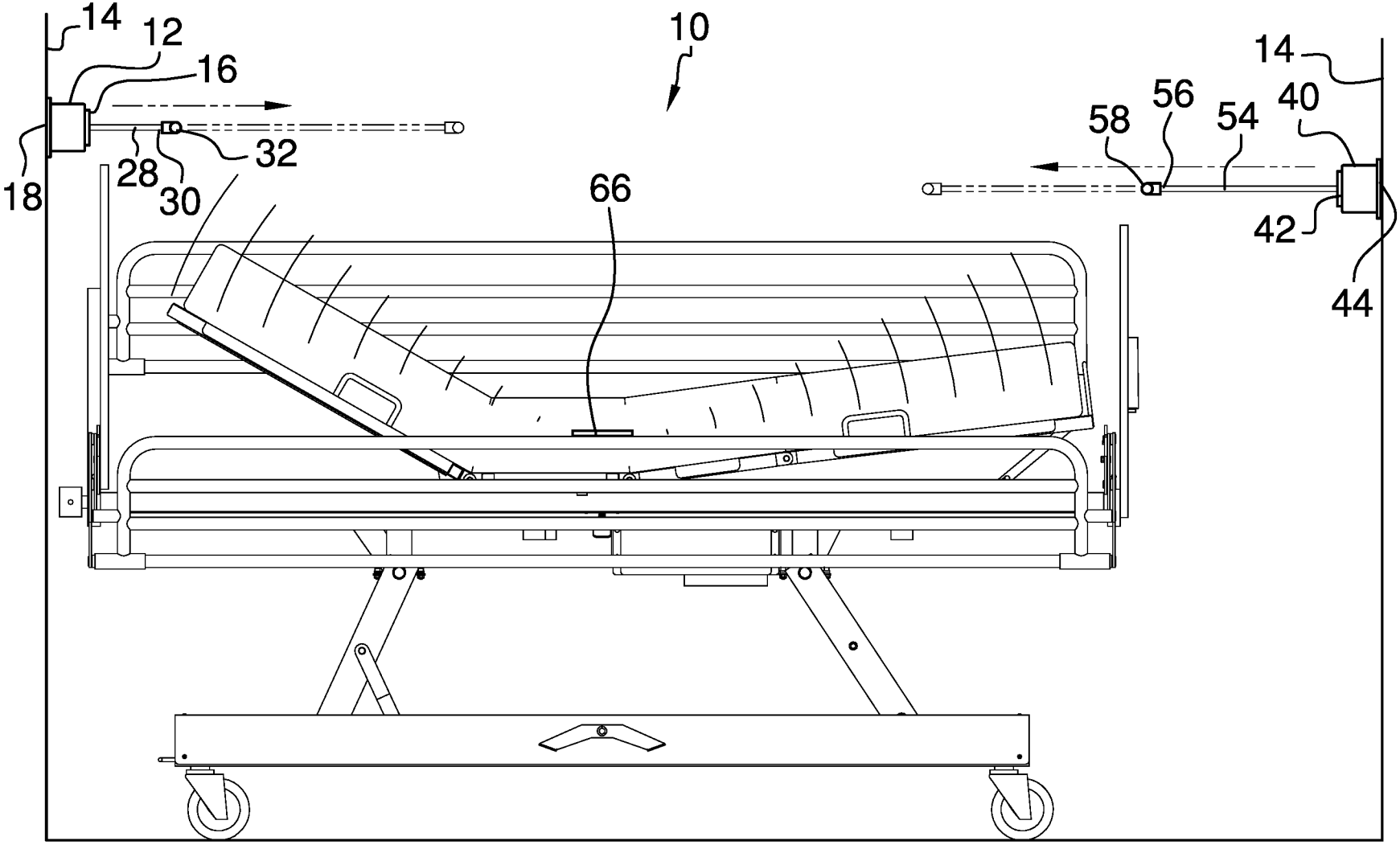
FIG. 7 is a perspective in-use view of an embodiment of the disclosure showing a first housing and a second housing each being coupled to a wall.
Figure 8:
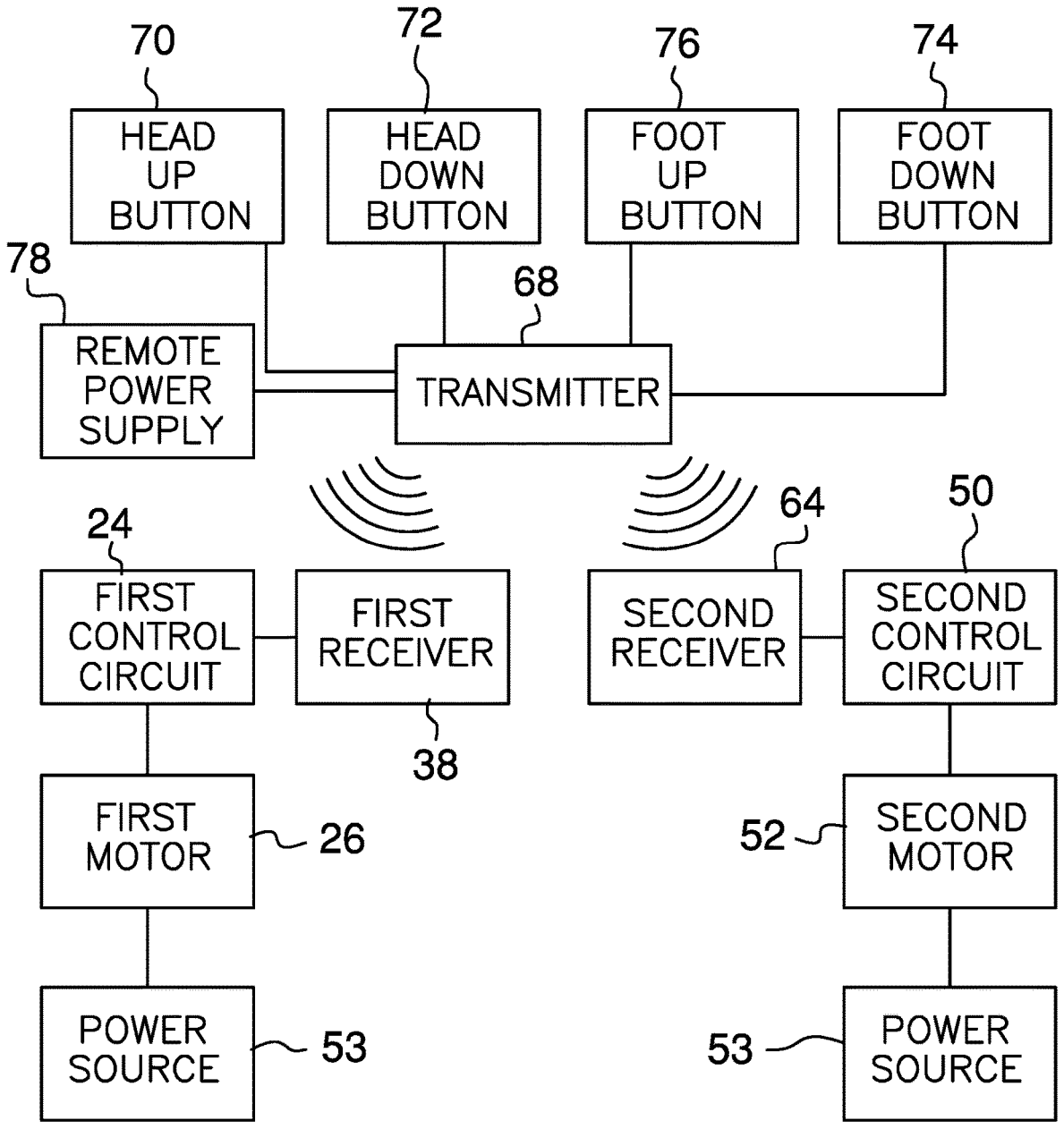
FIG. 8 is a schematic view of an embodiment of the disclosure.

With reference now to the drawings, and in particular to FIGS. 1 through 8 thereof, a new lifting device embodying the principles and concepts of an embodiment of the disclosure and generally designated by the reference numeral 10 will be described.

As best illustrated in FIGS. 1 through 8, the patient lifting assembly 10 generally comprises a first housing 12 that is coupled to a vertical support surface 14. The vertical support surface 14 may be a wall adjacent to a head of a bed or a headboard of the bed. In this way the first housing 12 can be positioned adjacent to a user's head when the user is lying in the bed. The bed may be a hospital bed, a bed for use in a home or any other type of bed for sleeping. The first housing 12 has a front wall 16 and a back wall 18, the back wall 18 is coupled to the vertical support surface 14. The front wall 16 has an aperture 20 extending into an interior of the first housing 12.

A first spool 22 is rotatably positioned within the first housing 12 and the first spool 22 is rotatable in a first direction or a second direction. A first control circuit 24 is positioned within the first housing 12 and the first control circuit 24 receives an extend input and a retract input. A first motor 26 is positioned within the first housing 12, the first motor 26 is coupled to the first spool 22 and the first motor 26 is electrically coupled to the first control circuit 24. The first motor 26 rotates the first spool 22 in the first direction when the first control circuit 24 receives the extend input. Conversely, the first motor 26 rotates the first spool 22 in the second direction when the first control circuit 24 receives the retract input. The first motor 26 is electrically coupled to a power source, such as a female electrical outlet via a power cord or the like and the first motor 26 may be an electric motor.

A first cable 28 is provided and the first cable 28 is wrapped around the first spool 22. The first cable 28 is retracted into the first housing 12 when the first spool 22 rotates in the first direction. Additionally, the first cable 28 is extended outwardly from the first housing 12 when the first spool 22 rotates in the second direction. The first cable 28 has a distal end 30 with respect to the first spool 22 and the first cable 28 extends through the aperture 20 in the first housing 12 such that the distal end 30 is exposed with respect to the first housing 12.

A first handle 32 is coupled to the first cable 28 such that the first handle 32 can be gripped by a user. The first handle 32 is moved away from the first housing 12 when the first spool 22 rotates in the first direction. In this way the first handle 32 can be positioned adjacent to the user thereby facilitating the user to grab the first handle 32. The first handle 32 is moved toward the first housing 12 when the first spool 22 rotates in the second direction to urge the user toward the first housing 12. In this way the user can be moved into an upright position.

The first handle 32 comprises a stem 34 and a grip 36 that is oriented transverse with the stem 34. The stem 34 has a distal end 38 with respect to the grip 36 and the distal end 38 of the stem 34 is coupled to the distal end 30 of the first cable 28. The user can grip the grip of the first handle 32 with the user's hands when the first cable 28 is played outwardly from the first housing 12. Thus, the user's upper body can be urged into an upright position when the first cable 28 is retracted into the first housing 12. A first receiver 38 is positioned within the first housing 12 and the first receiver 38 is electrically coupled to the first control circuit 24. The first receiver 38 may be radio frequency receiver or the like.

A second housing 40 is coupled to the vertical support surface 14 and the second housing 40 is oriented to face the first housing 12; the second housing 40 may be positioned on a foot board of the bed. In this way the second housing 40 can be positioned adjacent to a user's feet when the user is lying in the bed. The second housing 40 has a front wall 42 and a back wall 44. The back wall 44 of the second housing 40 is coupled to the vertical support surface 14 and the front wall 42 of the second housing 40 has an aperture 46 extending into an interior of the second housing 40.

A second spool 48 is rotatably positioned within the second housing 40 and the second spool 48 is rotatable in a primary direction or a secondary direction. A second control circuit 50 is positioned within the second housing 40 and the second control circuit 50 receives an extend input and a retract input. A second motor 52 is positioned within the second housing 40, the second motor 52 is coupled to the second spool 48 and the second motor 52 is electrically coupled to the second control circuit 50. The second motor 52 rotates the second spool 48 in the primary direction when the second control circuit 50 receives the extend input. Additionally, the second motor 52 rotates the second spool 48 in the secondary direction when the second control circuit 50 receives the retract input. The second motor 52 is electrically coupled to a power source 53, such as a female electrical outlet via a power cord or the like, and the second motor 52 may be an electric motor.

A second cable 54 is provided and the second cable 54 is wrapped around the second spool 48. The second cable 54 is retracted into the second housing 40 when the second spool 48 rotates in the secondary direction. Conversely, the second cable 54 is extended outwardly from the second housing 40 when the second spool 48 rotates in the primary direction. The second cable 54 has a distal end 56 with respect to the second spool 48 and the second cable 54 extends through the aperture 20 in the second housing 40 such that the distal end 56 of the second cable 54 is exposed with respect to the second housing 40.

A second handle 58 is coupled to the second cable 54 and the second handle 58 can be gripped by the user. The second handle 58 is moved away from the second housing 40 when the second spool 48 rotates in the primary direction. In this way the second handle 58 can be positioned adjacent to the user thereby facilitating the user to grab the second handle 58. The second handle 58 is moved toward the second housing 40 when the second spool 48 rotates in the secondary direction for urging the user toward the second housing 40. In this way the user can be moved into an upright position.

The second handle 58 comprises a stem 60 and a grip 62 that is oriented transverse with the stem 60. The stem 60 of the second handle 58 has a distal end 64 with respect to the grip 62 of the second handle 58. Additionally, the distal end 64 of the stem 60 of the second handle 58 is coupled to the distal end 56 of the second cable 54. The user can grasp the grip 62 on the second handle 58 when the second cable 54 is played outwardly from the second housing 40. In this way the user can be urged into an upright position when the second cable 54 is retracted into the second housing 40. A second receiver 64 is positioned within the second housing 40 and the second transceiver is electrically coupled to the second control circuit 50. The second receiver 64 may comprise a radio frequency receiver or the like.

A remote control 66 is provided and the remote control 66 is in electrical communication with the first spool 22 and the second spool 48. The remote control 66 actuates the first spool 22 to selectively rotate in the first and second directions. Additionally, the remote control 66 actuates the second spool 48 to rotate in the primary and secondary directions. The remote control 66 comprises a transmitter 68 that is positioned within the remote control 66. The transmitter 68 is in wireless electrical communication with each of the first 38 and second 64 receivers, and the transmitter 68 may comprise a radio frequency transmitter or the like.

A head up button 70 is movably coupled to the remote control 66 and the head up button 70 is electrically coupled to the transmitter 68. The first control circuit 24 receives the retract input when the head up button 70 is depressed. A head down button 72 is movably coupled to the remote control 66 and the head down button 72 is electrically coupled to the transmitter 68. Additionally, the first control circuit 24 receives the extend input when the head down button 72 is depressed.

A foot up button 74 is movably coupled to the remote control 66 and the foot up button 74 is electrically coupled to the transmitter 68. The second control circuit 50 receives the retract input when the foot up button 74 is depressed. A foot down button 76 is movably coupled to the remote control 66 and the foot down button 76 is electrically coupled to the transmitter 68. The second control circuit 50 receives the extend input when the foot down button 76 is depressed. A remote power supply 78 is positioned within the remote control 66, the remote power supply 78 is electrically coupled to the transmitter 68 and the remote power supply 78 comprises at least one battery.

In use, the foot down button 76 is depressed to extend the second cable 54 outwardly from the second housing 40 until the second handle 58 is close enough to the user for the user to grasp the second handle 58. The foot down button 76 is released and the foot up button 74 is depressed. Thus, the second cable 54 is retracted into the second housing 40 thereby urging the user into an upright, seated position without requiring assistance from a caregiver. The head down button 72 is depressed to extend the first cable 28 outwardly from the first housing 12 until the user can grasp the first handle 32. The head down button 72 is released and the head up button 70 is depressed. Thus, the first cable 28 is retracted into the first housing 12 thereby urging the user toward the headboard of the bed. In this way the user can be urged toward the headboard of the bed if the user has slid toward the foot of the bed without requiring assistance from a caregiver.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A patient lifting assembly being configured to be mounted on a bed thereby facilitating a user in the bed to grab a handle for urging the patient into an upright position, said assembly comprising:

a first housing being coupled to a vertical support surface wherein said first housing is configured to be positioned adjacent to a user's head when the user is lying in a bed;

a first spool being rotatably positioned within said first housing, said first spool being rotatable in a first direction or a second direction;

a first cable being wrapped around said spool, said first cable being retracted into said first housing when said spool rotates in said first direction, said first cable being extended outwardly from said first housing when said first spool rotates in said second direction;

a first handle being coupled to said first cable wherein said first handle is configured to be gripped by a user, said first handle being moved away from said first housing when said spool rotates in said second direction wherein said first handle is configured to be positioned adjacent to the user thereby facilitating the user to grab said first handle, said first handle being moved toward said first housing when said spool rotates in said first direction wherein said first handle is configured to urge the user toward said first housing, said first handle comprising a stem and a grip, said grip being elongated and cylindrical, said stem being coupled to a middle of said grip such that said grin extends laterally outward from said stem forming a T-shape, said stem having a distal end with respect to said grip, said distal end of said stem being coupled to said distal end of said first cable;

a second housing being coupled to a vertical support surface wherein said second housing is configured to be positioned adjacent to a user's feet when the user is lying in the bed, a second spool being rotatably positioned within said second housing, said second spool being rotatable in a primary direction or a secondary direction;

a second cable being wrapped around said spool, said second cable being retracted into said second housing when said spool rotates in said secondary direction, said second cable being extended outwardly from said second housing when said second spool rotates in said primary direction;

a second handle being coupled to said second cable wherein said second handle is configured to be gripped by a user, said second handle being moved away from said second housing when said second spool rotates in said primary direction wherein said second handle is configured to be positioned adjacent to the user thereby facilitating the user to grab said second handle, said second handle being moved toward said second housing when said second spool rotates in said secondary direction wherein said second handle is configured to urge the user toward said second housing thereby facilitating the user to be moved into an upright, seated position; and a remote control being in electrical communication with said first spool and said second spool, said remote control actuating said first spool to selectively rotate in said first and second directions, said remote control actuating said second spool to rotate in said primary and secondary direction.

2. The assembly according to claim 1, further comprising:

a first control circuit being positioned within said first housing, said first control circuit receiving an extend input and a retract input; and a first motor being positioned within said first housing, said first motor being coupled to said first spool, said first motor being electrically coupled to said first control circuit, said first motor rotating said first spool in said first direction when said first control circuit receives said extend input, said first motor rotating said first spool in said second direction when said motor control circuit receives said retract input, said first motor being electrically coupled to a power source.

3. The assembly according to claim 2, wherein:

said first housing has a front wall and a back wall, said back wall being coupled to the vertical support surface, said front wall having an aperture extending into an interior of said first housing; and said first cable has a distal end with respect to said first spool, said first cable extending through said aperture in said first housing such that said distal end is exposed with respect to said first housing.

4. The assembly according to claim 2, further comprising a first receiver being positioned within said first housing, said first receiver being electrically coupled to said first control circuit.

5. The assembly according to claim 4, wherein:

said second housing has a front wall and a back wall, said back wall of said second housing being coupled to the vertical support surface, said front wall of said second housing having an aperture extending into an interior of said second housing; and said second cable has a distal end with respect to said second spool, said second cable extending through said aperture in said second housing such that said distal end of said second cable is exposed with respect to said second housing.

6. The assembly according to claim 5, wherein said second handle comprises a stem and a grip, said grip of said second handle being elongated and cylindrical, said stem of said second handle being coupled to a middle of said grip of said second handle such that said grip of said second handle extends laterally outward from said stem of said second handle forming a T-shape, said stem of said second handle having a distal end with respect to said grip of said second handle, said distal end of said stem of said second handle being coupled to said distal end of said second cable.

7. The assembly according to claim 6, further comprising a second receiver being positioned within said second housing, said second receiver being electrically coupled to said second control circuit.

8. The assembly according to claim 7, wherein said remote control comprises:

a transmitter being positioned within said remote control, said transmitter being in wireless electrical communication with each of said first and second receivers;

a head up button being movably coupled to said remote control, said head up button being electrical coupled to said transmitter, said first control circuit receiving said retract input when said head up button is depressed; and a head down button being movably coupled to said remote control, said head down button being electrically coupled to said transmitter, said first control circuit receiving said extend input when said head down button is depressed.

9. The assembly according to claim 8, wherein said remote control further comprises:

a foot up button being movably coupled to said remote control, said foot up button being electrical coupled to said transmitter, said second control circuit receiving said retract input when said foot up button is depressed;

a foot down button being movably coupled to said remote control, said foot down button being electrically coupled to said transmitter, said second control circuit receiving said extend input when said foot down button is depressed; and a remote power supply being positioned within said remote control, said remote power supply being electrically coupled to said transmitter, said remote power supply comprising at least one battery.

10. The assembly according to claim 2, further comprising:

a second control circuit being positioned within said second housing, said second control circuit receiving an extend input and a retract input; and a second motor being positioned within said second housing, said second motor being coupled to said second spool, said second motor being electrically coupled to said second control circuit, said second motor rotating said second spool in said primary direction when said second control circuit receives said extend input, said second motor rotating said second spool in said secondary direction when said motor control circuit receives said retract input, said second motor being electrically coupled to a power source.

11. A patient lifting assembly being configured to be mounted on a bed thereby facilitating a user in the bed to grab a handle for urging the patient into an upright position, said assembly comprising:

a first housing being coupled to a vertical support surface wherein said first housing is configured to be positioned adjacent to a user's head when the user is lying in a bed, said first housing having a front wall and a back wall, said back wall being coupled to the vertical support surface, said front wall having an aperture extending into an interior of said first housing;

a first spool being rotatably positioned within said first housing, said first spool being rotatable in a first direction or a second direction;

a first control circuit being positioned within said first housing, said first control circuit receiving an extend input and a retract input;

a first motor being positioned within said first housing, said first motor being coupled to said first spool, said first motor being electrically coupled to said first control circuit, said first motor rotating said first spool in said first direction when said first control circuit receives said extend input, said first motor rotating said first spool in said second direction when said motor control circuit receives said retract input, said first motor being electrically coupled to a power source;

a first cable being wrapped around said first spool, said first cable being retracted into said first housing when said first spool rotates in said first direction, said first cable being extended outwardly from said first housing when said first spool rotates in said second direction, said first cable having a distal end with respect to said first spool, said first cable extending through said aperture in said first housing such that said distal end is exposed with respect to said first housing;

a first handle being coupled to said first cable wherein said first handle is configured to be gripped by a user, said first handle being moved away from said first housing when said first spool rotates in said second direction wherein said first handle is configured to be positioned adjacent to the user thereby facilitating the user to grab said first handle, said first handle being moved toward said first housing when said first spool rotates in said first direction wherein said first handle is configured to urge the user toward said first housing thereby facilitating the user to be toward a head of the bed, said first handle comprising a stem and a grip, said grip being elongated and cylindrical, said stem being coupled to a middle of said grip such that said grip extends laterally outward from said stem forming a T-shape, said stem having a distal end with respect to said grip, said distal end of said stem being coupled to said distal end of said first cable;

a first receiver being positioned within said first housing, said first receiver being electrically coupled to said first control circuit;

a second housing being coupled to a vertical support surface wherein said second housing is configured to be positioned adjacent to a user's feet when the user is lying in the bed, said second housing having a front wall and a back wall, said back wall of said second housing being coupled to the vertical support surface, said front wall of said second housing having an aperture extending into an interior of said second housing;

a second spool being rotatably positioned within said second housing, said second spool being rotatable in a primary direction or a secondary direction;

a second control circuit being positioned within said second housing, said second control circuit receiving an extend input and a retract input;

a second motor being positioned within said second housing, said second motor being coupled to said second spool, said second motor being electrically coupled to said second control circuit, said second motor rotating said second spool in said primary direction when said second control circuit receives said extend input, said second motor rotating said second spool in said secondary direction when said motor control circuit receives said retract input, said second motor being electrically coupled to a power source;

a second cable being wrapped around said second spool, said second cable being retracted into said second housing when said second spool rotates in said secondary direction, said second cable being extended outwardly from said second housing when said second spool rotates in said primary direction, said second cable having a distal end with respect to said second spool, said second cable extending through said aperture in said second housing such that said distal end of said second cable is exposed with respect to said second housing;

a second handle being coupled to said second cable wherein said second handle is configured to be gripped by a user, said second handle being moved away from said second housing when said second spool rotates in said primary direction wherein said second handle is configured to be positioned adjacent to the user thereby facilitating the user to grab said second handle, said second handle being moved toward said second housing when said second spool rotates in said secondary direction wherein said second handle is configured to urge the user toward said second housing thereby facilitating the user to be moved into an upright, seated position, said second handle comprising a stem and a grip, said grip of said second handle being elongated and cylindrical, said stem of said second handle being coupled to a middle of said grip of said second handle such that said grin of said second handle extends laterally outward from said stem of said second handle forming a T-shape, said stem of said second handle having a distal end with respect to said grip of said second handle, said distal end of said stem of said second handle being coupled to said distal end of said second cable;

a second receiver being positioned within said second housing, said second receiver being electrically coupled to said second control circuit; and a remote control being in electrical communication with said first spool and said second spool, said remote control actuating said first spool to selectively rotate in said first and second directions, said remote control actuating said second spool to rotate in said primary and secondary directions, said remote control comprising:

a transmitter being positioned within said remote control, said transmitter being in wireless electrical communication with each of said first and second receivers;

a head up button being movably coupled to said remote control, said head up button being electrical coupled to said transmitter, said first control circuit receiving said retract input when said head up button is depressed;

a head down button being movably coupled to said remote control, said head down button being electrically coupled to said transmitter, said first control circuit receiving said extend input when said head down button is depressed;

a foot up button being movably coupled to said remote control, said foot up button being electrical coupled to said transmitter, said second control circuit receiving said retract input when said foot up button is depressed;

a foot down button being movably coupled to said remote control, said foot down button being electrically coupled to said transmitter, said second control circuit receiving said extend input when said foot down button is depressed; and a remote power supply being positioned within said remote control, said remote power supply being electrically coupled to said transmitter, said remote power supply comprising at least one battery.

* * * * *